US005427284A

United States Patent [19]

Inch

[11] Patent Number: 5,427,284

[45] Date of Patent: Jun. 27, 1995

[54] ELASTOMERIC LINER FOR LIQUID SOAP AND LOTION DISPENSER

[75] Inventor: John Inch, Indianapolis, Ind.

[73] Assignee: Masco Corporation of Indiana, Taylor, Mich.

[21] Appl. No.: 160,342

[22] Filed: Dec. 1, 1993

[51] Int. Cl.[6] ..... B65D 88/54

[52] U.S. Cl. ..... 222/566; 222/321.3

[58] Field of Search ..... 239/591; 138/143; 4/678; 222/321, 214, 385, 564, 566

[56] References Cited

U.S. PATENT DOCUMENTS

| | | | |
|---|---|---|---|
| 1,219,309 | 3/1917 | Holland | 239/591 X |
| 2,923,482 | 2/1960 | Bucknell | 239/591 |
| 3,785,572 | 1/1974 | Arnold et al. | 239/518 |
| 4,120,429 | 10/1978 | Vignot | 222/321 X |
| 4,168,033 | 9/1979 | von Bernuth et al. | 239/591 X |
| 4,513,885 | 4/1985 | Hogan | 222/214 X |
| 4,570,829 | 2/1986 | Allen | 222/214 X |

*Primary Examiner*—Andres Kashnikow
*Assistant Examiner*—Kenneth Bomberg
*Attorney, Agent, or Firm*—Myron B. Kapustij; Malcolm L. Sutherland

[57] ABSTRACT

A synthetic organic material, such as a polymeric elastomeric material, or natural or synthetic rubber liner for brass liquid soap or lotion dispenser adapted to fit within the dispenser to prevent liquid soap or lotion from coming into contact with the brass dispenser. The liner comprises a hollow tubular member adapted to fit within the spout of the dispenser and an enlarged diameter base portion adapted to fit within the body of the dispenser.

5 Claims, 2 Drawing Sheets

ELASTOMERIC LINER FOR LIQUID SOAP AND LOTION DISPENSER

FIELD OF THE INVENTION

This invention relates to liquid soap and/or lotion dispenser made of brass having a protective plastic liner.

BACKGROUND OF THE INVENTION

Liquid soap and/or lotion dispensers are well known and quite prevalent. They can be mounted on counters or sinks and dispense liquid soap or lotion. They normally consist of these parts: a dispenser comprising a body and spout, a pump connected to the dispenser, and a reservoir containing the liquid soap or lotion. To operate the liquid soap and lotion dispenser one normally presses down on the body of the dispenser to operate the pump and pump the liquid soap from the reservoir out the spout.

However, a problem is encountered when the dispenser is comprised of brass. Some liquid soaps will, after repeated and prolonged contact with the brass, eventually dissolve the brass. There thus exists a need to provide a means whereby brass dispensers can be used with all types of liquid soaps and lotions. The instant invention provides such a means.

SUMMARY OF THE INVENTION

The instant invention is directed to a protective liner for a brass liquid dispenser. The liner fits into the body and spout of the dispenser and the liquid soap or lotion travels from the soap and lotion reservoir through the liner and does not come into contact with the brass. The liner is in the form of a hollow tubular member having an enlarged diameter base and a discharge opening at right angles to its longitudinal axis adjacent its distal end. The liner is elastic and flexible and is comprised of an elastomeric polymeric composition.

DESCRIPTION OF THE PREFERRED EMBODIMENTS

Figure 3:
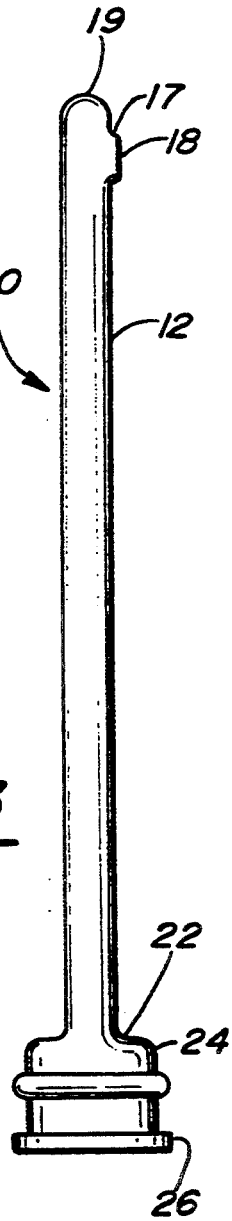
FIG. 3 is a side elevational view of the liner of the instant invention.
Figure 4:
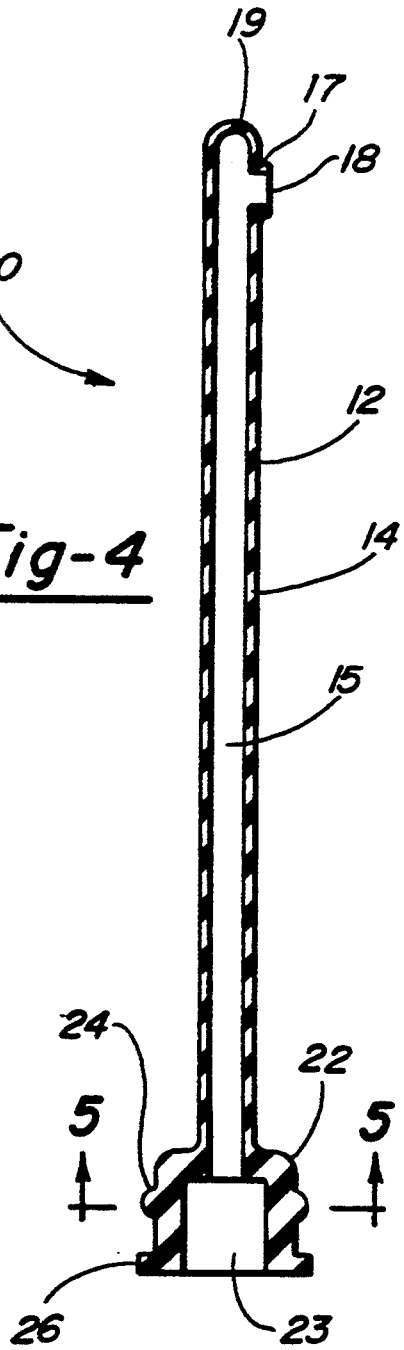
FIG. 4 is a sectional view of the liner of FIG. 3.

As best illustrated in FIGS. 3 and 4 the liner 10 comprises a long hollow tubular member 12 formed by side wall 14 and an enlarged diameter base section 22. A discharge opening 18 is formed in side wall 14 adjacent tip 19. The discharge opening 18 is surrounded by circular lip 17. Discharge opening 18 is substantially at right angles to the longitudinal axis of tubular member 12. Discharge opening 18 is in communication with passageway 15.

Figure 5:
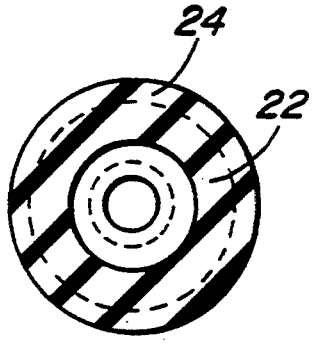
FIG. 5 is a sectional view taken along line 5—5 in FIG. 4.

As illustrated in FIGS. 3 and 5 the enlarged diameter base section 22 has a radially extending annular ridge 24 and a base flange 26. The enlarged diameter base section 22 has an enlarged inlet passageway which is in communication with passageway 15. Inlet passageway 23 is adapted to receive the tip of a pump (not shown).

The liner is generally comprised of synthetic organic materials or natural rubber. The synthetic organic materials, i.e., polymeric materials, are preferably polymeric materials exhibiting elastomeric properties, i.e., elastomers. Such materials include butadiene-rubber, polyvinyl chloride, acrylonitrile-butadiene-styrene, butadiene-styrene, thermoplastic elastomers such as santoprene, and the like. All of these materials are well known in the art and are generally commercially available. A preferred material is polyvinyl chloride.

Figure 1:
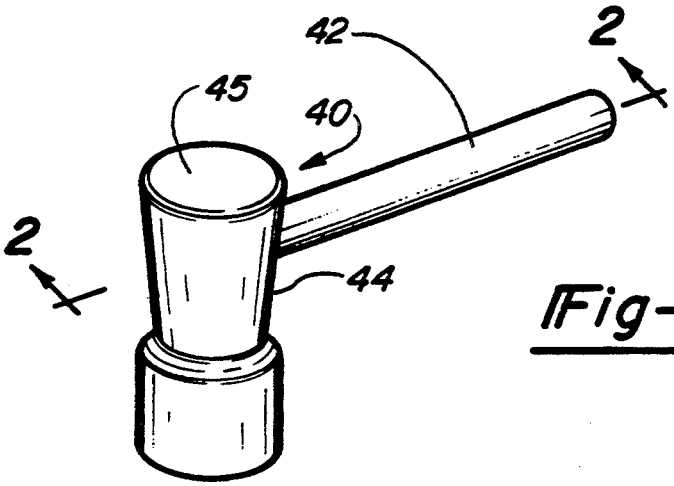
FIG. 1 is a perspective view of the dispenser.
Figure 2:
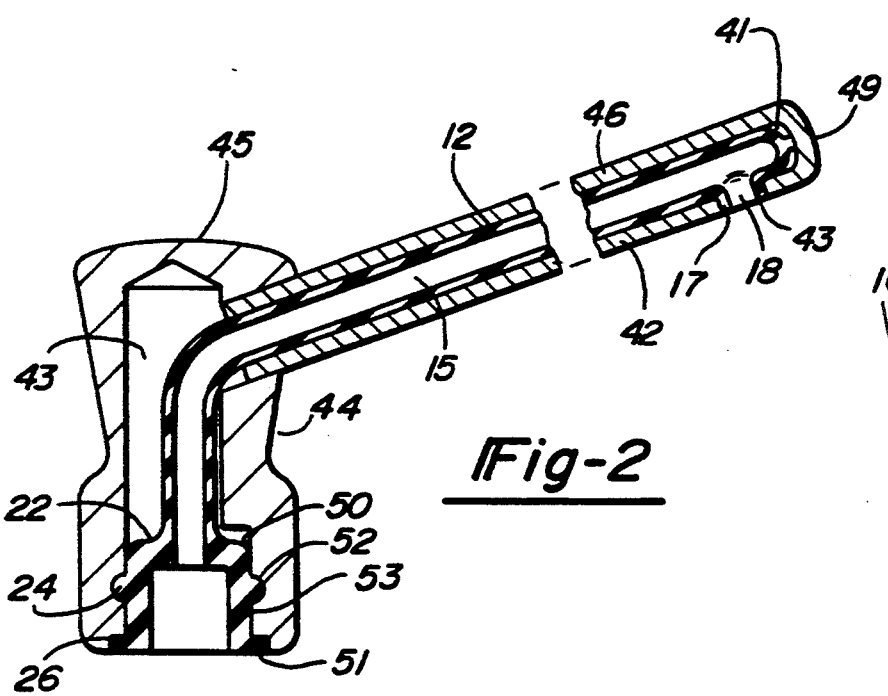
FIG. 2 is a sectional view taken along lines 2—2 in FIG. 1 showing the liner of FIG. 3 disposed inside the dispenser.

The liner 10 is sufficiently flexible and elastic so that it can be inserted, as illustrated in FIG. 2, into the dispenser 40. The dispenser is made of brass and may have a protective nickel, chrome, and the like coating layer on the exterior surface thereof. As best illustrated in FIGS. 1 and 2 the dispenser comprises a spout 42 connected to a body 44 having a top 45. The body contains internal body cavity 43 which is in communication with spout passageway 41 in spout 42. The tubular member 12 is disposed in the spout passageway 41 and in the body passageway 43, being bent at the juncture of passageways 41 and 43, with the discharge opening 18 in the tubular member 12 being aligned with opening 43 in wall 46 of spout 42 adjacent spout tip 49. More specifically the lip 17 surrounding discharge opening 18 extends into opening 43.

In the interior wall 50 of the body 44 is an annular shaped recess 52 adapted to receive annular ridge 24 of base section 22 of liner 10. A second annular recess 51 adjacent the bottom of the body 44 is adapted to receive base flange 26.

The liner is inserted through the open bottom of body 44 with the upper section of tubular member 12 being disposed in spout passageway 41 in spout 42. The base section 22 of the liner is pushed upwardly into the cavity 43 in body 44 until the annular ridge snaps into recess 52. The liner 10 being elastic and flexible the ridge 24 is compressed in passing through area 53 which has a smaller internal diameter than recess 51 and 52. The tip of the pump is inserted into opening 23 of liner 10. Both the annular ridge 24 and the base flange 26 are integrally formed with the base section 22. The entire liner 10 is of an integral one piece construction.

Figure 6:
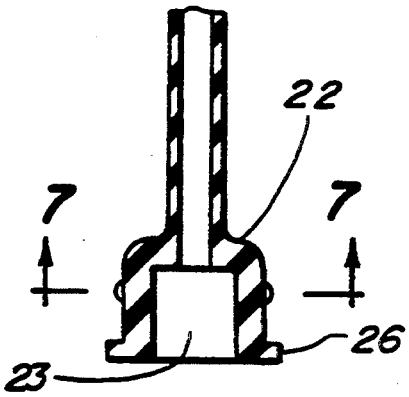
FIG. 6 is a fragmentary sectional view of another embodiment of the enlarged diameter base section.
Figure 7:
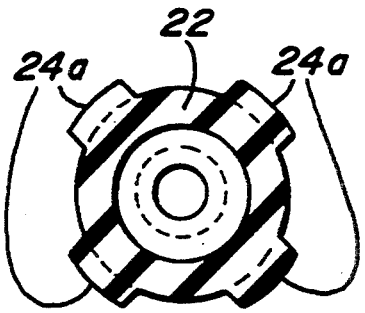
FIG. 7 is a sectional view taken along line 7—7 in FIG. 6.

In another embodiment, as illustrated in FIGS. 6 and 7, the base section 22, instead of having annular ridge 24 extending completely around the exterior of base 22, has radially extending tabs **24*a* circumferentially spaced apart from each other disposed on the surface of base section 22. The tabs 24*a* are adapted to fit within recess 52 in the body 44 of dispenser 40. The tabs 24*a* are formed integrally with the base section 22**.

With the liner 10 in place in the dispenser 40 the liquid soap does not come into contact with the brass. Its entire flow through the dispenser 40 occurs within the liner.

The liner, being separate and distinct from the dispenser, pump and reservoir, can be easily removed and replaced should it become damaged.

The preceding detailed description describes the preferred embodiments contemplated for carrying out the present invention. Further variations and modifications not departing from the spirit of the present invention may be apparent to those skilled in the art and are included within the intended scope of the appended claims.

What is claimed is:

1. A liner comprised of flexible polyvinyl chloride for insertion into a brass liquid soap dispenser comprising a vertically extending base member having a first bore therein and a spout section extending from said base member having a second bore therein in communication with said first bore, said liner being inserted into said first and second bores.

2. The liner of claim 1 which includes a long hollow tubular member having a longitudinal axis, having a first end and a second end, and having an enlarged diameter base section having an exterior surface at said first end thereof.

3. The liner of claim 2 wherein said long hollow tubular member includes a closed tip at said second end thereof, and an outlet opening extending transversely of the longitudinal axis thereof proximate said tip.

4. The liner of claim 3 wherein said base section includes means for securing said liner in said soap dispenser.

5. The liner of claim 4 wherein said means comprises two axially extending axially spaced apart bulged sections on the exterior surface of said base section adapted to engage corresponding recesses in the bore of the base member of said soap dispenser.

* * * * *